United States Patent [19]

White et al.

[11] 4,153,292

[45] May 8, 1979

[54] RECLINER CHAIR

[75] Inventors: David B. White; William Pacitti; Edwin G. Gensler, all of Monroe, Mich.

[73] Assignee: La-Z-Boy Chair Company, Monroe, Mich.

[21] Appl. No.: 548,892

[22] Filed: Feb. 11, 1975

[51] Int. Cl.[2] ..... A47C 1/02

[52] U.S. Cl. ..... 297/83; 297/317

[58] Field of Search ..... 297/68, 69, 83, 85, 297/317, 84; 312/331

[56] References Cited

U.S. PATENT DOCUMENTS

| | | | |
|---|---|---|---|
| Re. 28,210 | 10/1974 | Ré | 297/83 |
| 426,602 | 4/1890 | Mühl | 297/68 |
| 1,171,974 | 2/1916 | Pelton | 312/331 |
| 2,982,340 | 5/1961 | Spound | 297/61 |
| 3,357,739 | 12/1967 | Knabusch et al. | 297/69 |
| 3,858,932 | 1/1975 | Crum et al. | 297/85 |

*Primary Examiner*—James T. McCall

*Attorney, Agent, or Firm*—Harness, Dickey & Pierce

[57] ABSTRACT

A reclining chair that is disposable adjacent a wall and can recline at the wall. The chair includes a chair frame, a back frame, a seat frame, a platform, and first and second link assemblies. The first link assembly connects the back frame to the seat frame and the chair frame on both sides permitting the back frame to recline and the seat frame to move relative to the back frame forwardly and upwardly. The second link assembly has arms connected to the first link assembly for moving the back, seat and chair frames simultaneously forwardly on the platform a predetermined distance of forward movement along with the arms of the second link assembly, so that the arms of the second link assembly move the same distance forwardly plus an additional distance forwardly as the back frame is being reclined.

6 Claims, 7 Drawing Figures

19
28
26
43
44
45
31
32
33
34
35
36
37
38
39
41
42
15
12
27
22
21
23
7

RECLINER CHAIR

BACKGROUND OF THE INVENTION

Reference may be had to U.S. Pat. No. Re. 28,210 and the art which was cited in the parent case U.S. Pat. No. 3,758,151 and also U.S. Pat. No. 825,984 to show prior disclosures covering this type of chair.

SUMMARY OF THE INVENTION

A standard type of overstuffed chair having a chair frame to which a seat and back frame are connected and supported by side link mechanisms which permits the back to tilt backwardly on the chair frame and causes the seat frame to move upwardly and forwardly as the back frame reclines. The chair frame has supporting plates for forward and rearward rollers which are mounted below each side to extend downwardly therefrom into a pair of facing channels mounted on a platform on which the frame is supported for forward and rearward movement on the rollers. As the frame moves forwardly, the back can recline and still maintain the top edge of the back frame within a vertical plane so that when disposed directly adjacent to a wall the back frame may be reclined. A link on each of the back frame link mechanisms are connected to a pair of arms on an arm link mechanism which advances therewith when the back frame is reclined. The opposite ends of the arm link mechanism have a roller mounted on each side which rides within the facing channels on the platform between the two rollers on which the chair frame rolls. Two pairs of scissors links of different length are interconnected to each other by a central pivot with the ends of one set of links pivoted to the back of the chair frame and the other set pivoted to a cross member on the arm link mechanism. The central pivot which connects the two sides of scissors links is connected to a cross brace on the chair frame so that as the arms are moved the scissors links are moved therewith to advance the seat frame at a lesser rate of movement than that of the arms so as to have the frames move forwardly a desired amount. The rollers on the arm link mechanism are normally disposed adjacent to the rear rollers on the chair frame and after the frames are moved forwardly the rollers on the arm link mechanism substantially engage the forward rollers of the frames when the back frame is in reclined position. This forward movement of the frames occurs on the platform without the advancement of the top of the back frame from the wall and without the manipulation of the legrest links since they may or may not be extended at the time the back frame is being reclined.

DESCRIPTION OF THE PREFERRED EMBODIMENT

Figures 1, 2:
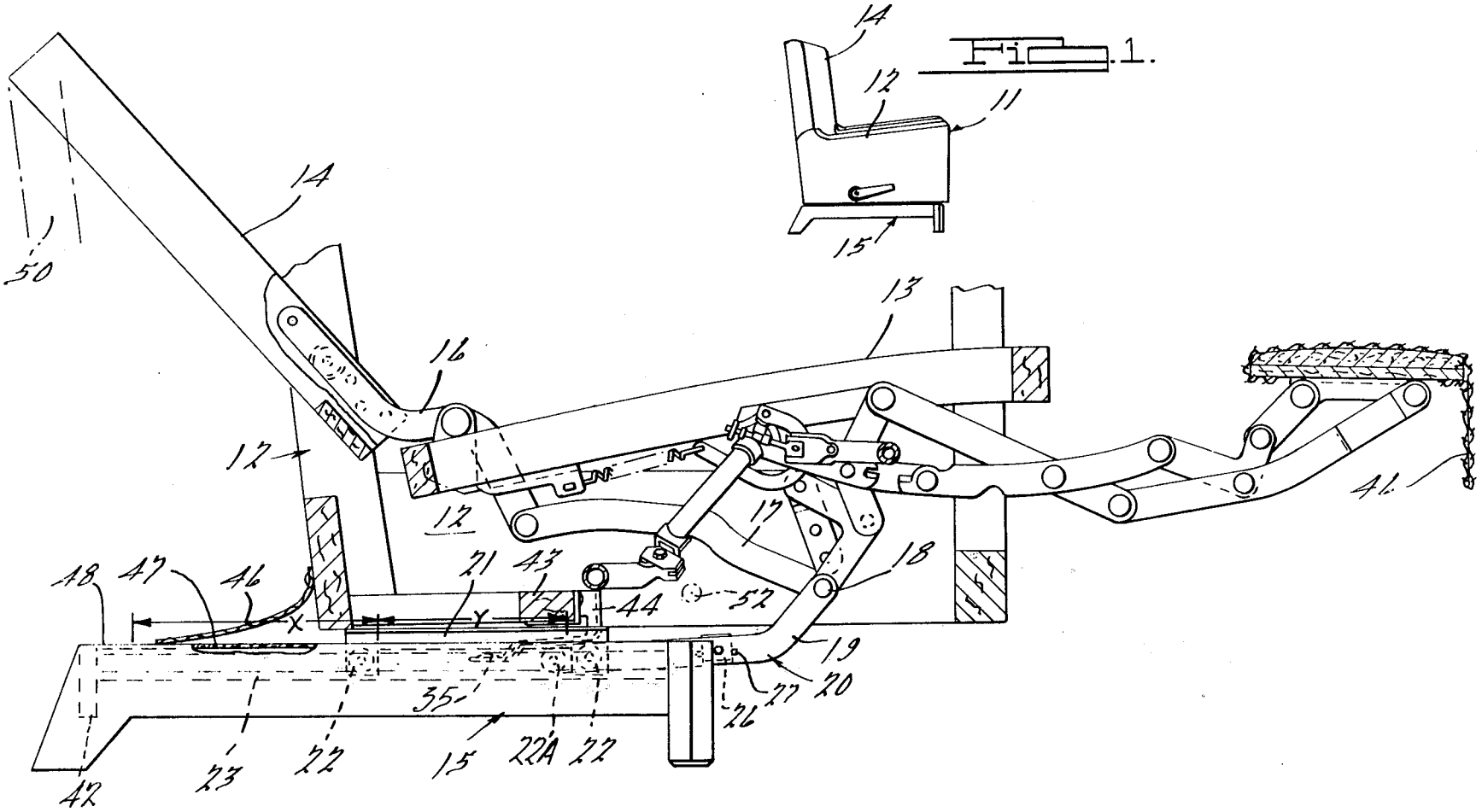
FIG. 1 is a view in side elevation of a chair which is mounted on a platform and advanced thereon when the back frame is tilted rearwardly in a manner embodying features of the present invention.
FIG. 2 is a sectional view of the chair illustrated in FIG. 1, when in reclined position with the legrest extended.
Figure 3:
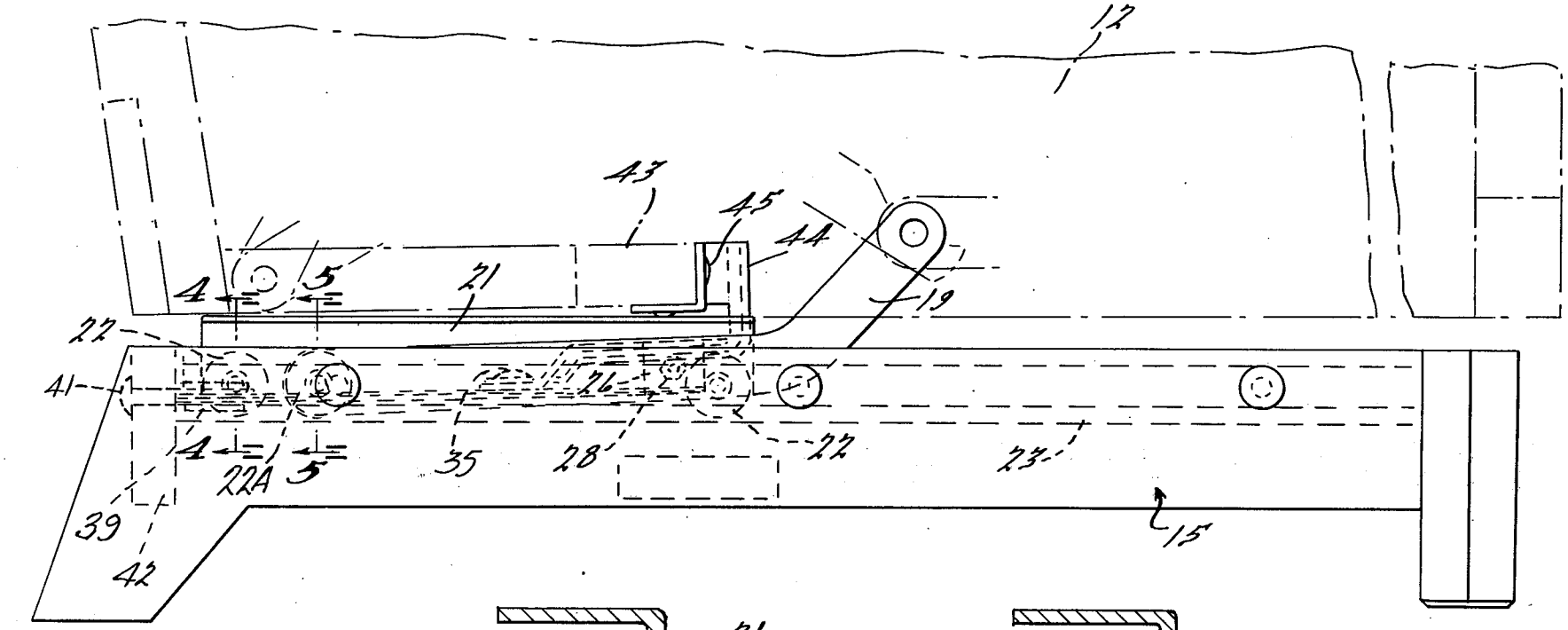
FIG. 3 is an enlarged view of the base illustrated in FIG. 2, when in retracted position with the back in upright position.
Figure 5:
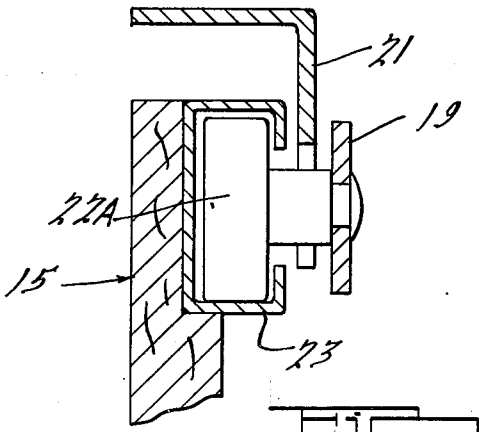
FIG. 5 is an enlarged sectional view of the structure illustrated in FIG. 3, taken on the line 5—5 thereof.

In FIG. 1, a chair 11 of the reclining type is illustrated having a chair frame 12, a seat frame 13 and a back frame 14 all of which is mounted on a platform 15. As illustrated in FIG. 2, a back frame is connected to a seat frame at each side by link mechanisms 16 which are also connected to a seat frame 13 which will advance forwardly and upwardly as the back frame is tilted rearwardly. The link mechanisms 16 have links 17 with a pivot 18 on the ends which are connected to a pair of spaced arms 19 of an arm link mechanism 20. The chair frame 12 has downwardly extending metal elements 21 on its bottom side edges which have a roller 22 at the forward and at the rearward ends disposed within facing channel elements 23 mounted on the inner sides of the platform 15 to extend substantially the full length thereof.

Figure 4:
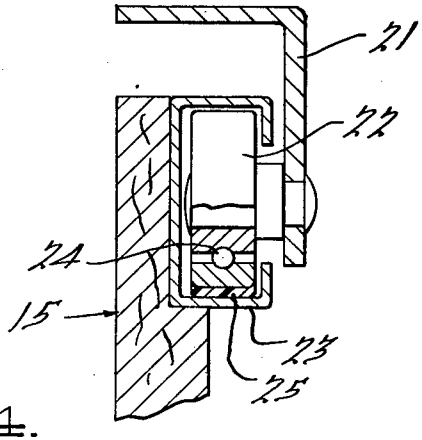
FIG. 4 is an enlarged sectional view of the structure illustrated in FIG. 3, taken on the line 4—4 thereof.
Figures 6, 7:
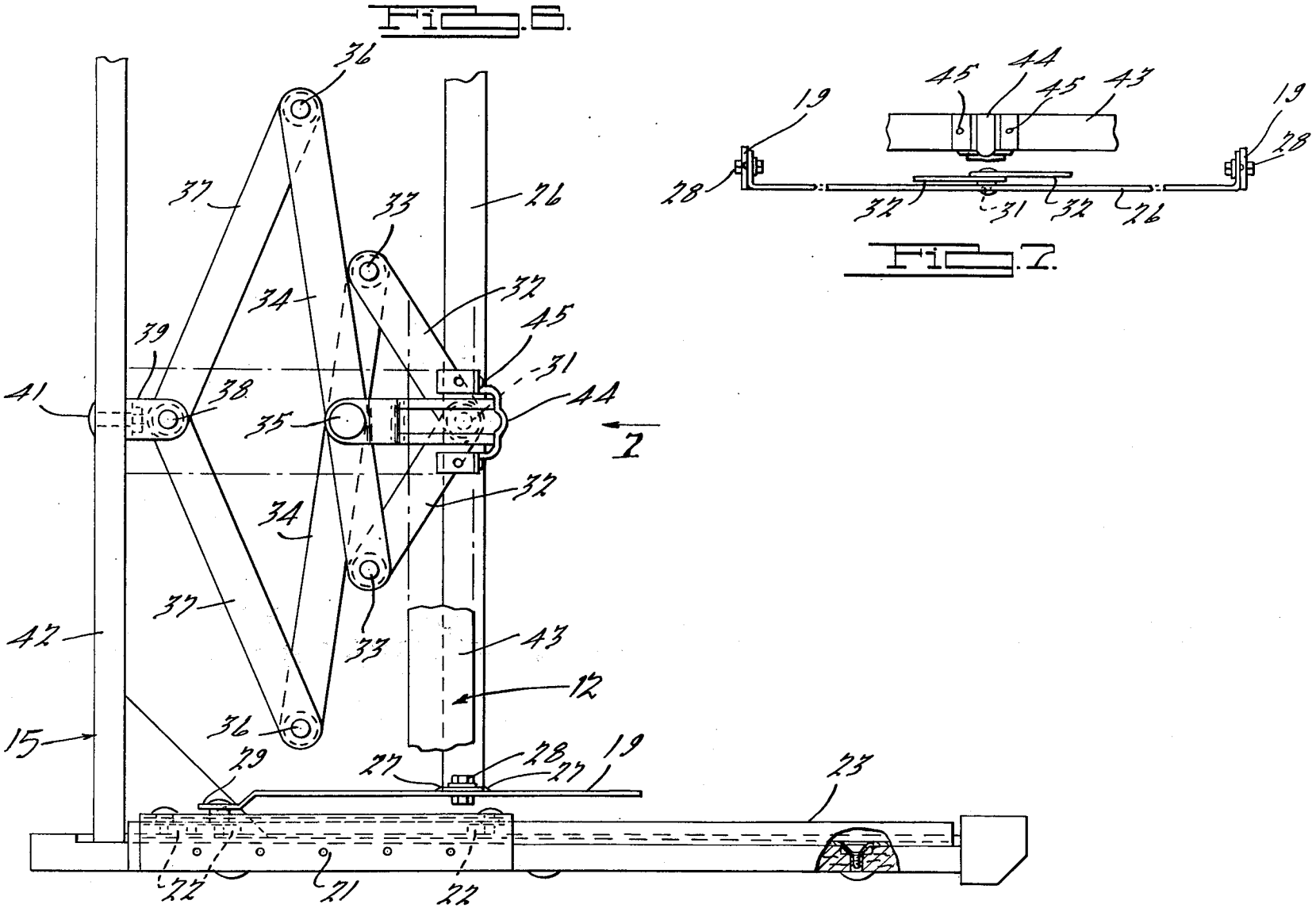
FIG. 6 is a broken plan view, with parts in section, of the structure illustrated in FIG. 3.
FIG. 7 is a reduced view of the structure illustrated in FIG. 6, as viewed from the point 7 thereof.

The rollers, as illustrated in FIG. 4, have a row of ball bearings 24 between races and a Nylon tire 25 on the outer rim. The rollers and tire reduce the noise and friction which otherwise might be present. The offset arms 19 are interconnected by a cross member 26 (see FIG. 6) having end flanges disposed at right angle and positioned between punched out teats 27 to prevent the ends from turning when secured by bolts 28. The rearward end 29 of the arms 19 of the arm link mechanism 20 has like rollers 22A mounted thereon and disposed within the channel elements 23 between the pair of rollers 22 which are supported on the metal element 21. When the occupant of the chair leans backward against the back frame 14, it will swing downwardly from the dot and dash position 50 to advance the links 17 and therefore the offset arms 19 and the mechanism 20. The cross member 26 of the mechanism 20 has a central aperture 31 to which the forward ends of a pair of links 32 are secured, as illustrated in FIG. 6. The links 32 are connected by pivots 33 to the ends of a pair of cross links 34 which are interconnected at the center by a pivot 35. Rivets 36 on the outer ends of the links 34 are connected to the outer ends of a pair of links 37 which are secured by a pivot 38 to a bracket 39 which is attached by a bolt 41 to the back cross member 42 of the platform 15. A cross member 43 on the chair frame 12 is spaced forwardly of the cross member 42 the cross member 43 having a reinforced bracket 44 secured thereto by screws 45 with the rearward end secured to the pivot 35 (see FIG. 6). When the back frame is tilted rearwardly, the arms 19 are advanced from the point 52 occupied by the pivot 18 forwardly by the links 17 to the position occupied by the pivot 18, as illustrated in FIG. 2 carrying the links 32 forwardly therewith. The links 32 and 37 form a double-scissors linkage arrangement which pulls the chair frame 12 forwardly on the platform 15. The links 32, 37 are of different length and are interconnected to each other by central pivot 35, with the ends of the links 37 connected to platform 15 at 39 (see FIG. 6), and the links 32 pivoted to cross member 26 of the link mechanism 20. The central pivot 35 connects the links 32, 37 together with links 34 to a cross brace 43 on the chair frame 12 so that as the arms 19 are moved the scissors links 32, 34, 37 are moved therewith to advance the seat frame 12 at a lesser rate of movement than that of the arms 19 so as to move the frames 12, 13, and 14 forwardly together a desired amount. The arms 19 advance at a faster rate than frame 12 since the pair of rollers 22A thereof move from a position adjacent to the rear pair of rollers 22 of the frames 21 to an advanced position adjacent to the pair of forward rollers 22 thereof. In other words, the arm link mechanism 20 advances the distance Y between pair of rollers 22 on the chair frame and also the distance X that the chair frame advances. Thus, the offset arms 19 move with and relative to the chair frame 12 as the latter is advanced on the platform.

After the chair has been reclined in this manner with the top edge of the back frame spaced the same distance from the wall in all positions, the leaning forward on the seat frame 13 causes the back frame to move to upright position. Due to the rearward movement of the links 17, the offset arms 19 are moved rearwardly therewith, closing the scissors links 33 and 37 and moving them into the position illustrated in FIG. 6 at which time the back frame is in upright position with the chair frame 12 moved to the rear of the platform 15.

Reference may be had to U.S. Pat. No. 3,357,739 (the disclosure of which is hereby incorporated by reference herein) for a disclosure of the first link mechanism 16. It is to be understood that the chair may be completely upholstered with skirts 46 extending around the platform 15 to hide it from view. A thin panel 47 may be secured at the rear end 48 of the platform 15 to permit the skirt 46 to slide thereon and back to vertical position when the chair is in normal seating position.

We claim:

1. In a reclining chair disposable adjacent to a wall and reclined thereat, a chair frame, a back frame, a seat frame, a platform, a first link means for connecting said back frame to said seat frame and said chair frame on both sides thereof permitting the back frame to recline and the seat frame to move relative to said back frame forwardly and upwardly, and a second link means, having arms connected to said first link means for moving the back, seat and chair frames simultaneously forwardly on said platform a predetermined distance of forward movement along with said arms of the second link means, so that said arms of said second link means move the same distance forwardly plus an additional distance forwardly as said back frame is being reclined.

2. In a reclining chair as recited in claim 1, wherein said chair frame has forward and rearward rollers on the bottom thereof, wherein said platform includes channel means on both sides of the platform, in which said rollers are supported for forward and rearward movement, and wherein a roller is mounted on each of said arms and is disposed in said channel means between said chair frame rollers.

3. In a reclining chair as recited in claim 2, wherein the rollers on said arms are disposed adjacent to the rearward rollers on the chair frame when the back frame is in upright position and disposed adjacent to said forward rollers when said back frame is in reclined position to permit said arms to move the distance the chair frame moves and in addition at least a substantial part of the distance between the forward and rearward rollers of the chair frame.

4. In a reclining chair as recited in claim 3, wherein said arms have a pair of scissors links secured together by a pivot with the rear end of the rear links pivoted to the chair frame, pivot means connecting the front end of the front links of the scissors links to said arms, and means connecting the pivot of said pair of scissors links to a forward part of the seat frame which permits the arms to move a greater distance than said chair frame.

5. In a reclining chair as recited in claim 1, wherein a legrest and its mechanism are carried by the seat frame, and a handle for operating the legrest to extended and retracted position mounted on said chair frame and operable in any position of said chair frame on said platform.

6. In a reclining chair as recited in claim 1, wherein an apron is provided about the edge of the chair frame, and a thin panel secured at its rear end to the rear of the platform over which the apron at the rear of the chair frame slides and which drops downwardly over the rear of the platform when the chair back is in upright position.

* * * * *